United States Patent [19]

Piatti

[11] 4,365,595

[45] Dec. 28, 1982

[54] ACTUATION OF VALVES OF INTERNAL COMBUSTION ENGINES

[76] Inventor: Sanzio P. V. Piatti, 14 Corso Porta Nuova, Milano, Italy

[21] Appl. No.: 105,230

[22] Filed: Dec. 19, 1979

[30] Foreign Application Priority Data

Dec. 27, 1978 [IT] Italy ..... 31314 A/78

[51] Int. Cl.[3] ..... F01L 1/22

[52] U.S. Cl. ..... 123/90.53

[58] Field of Search ..... 123/90.48, 90.52, 90.53

[56] References Cited

U.S. PATENT DOCUMENTS

| | | | |
|---|---|---|---|
| 1,580,846 | 4/1926 | Miller | 123/90.49 |
| 1,613,117 | 1/1927 | Miller | 123/90.49 |
| 1,784,125 | 12/1930 | Wilson et al. | 123/90.49 |
| 2,066,976 | 1/1937 | Holmes | 123/90.49 |
| 2,130,001 | 9/1938 | Fitts | 123/90.49 |

*Primary Examiner*—Craig R. Feinberg
*Assistant Examiner*—W. R. Wolfe
*Attorney, Agent, or Firm*—Brisebois & Kruger

[57] ABSTRACT

The invention provides an inexpensive and simple mechanical spring system which automatically compensates for variations in the clearance gap in the valve-actuating mechanism of internal combustion engines, whereby considerably to lengthen the time an engine can be in operation before manual adjustment of the clearance gap becomes necessary. The system comprises at least one thin metal disc located between a convex surface in contact with the center of one face of the disc and an annular surface in contact with the periphery of the other face of the disc, movement of the surfaces together deforming the disc around the convex surface to produce a spring force which increases at a variable rate until it exceeds the valve spring loading and the valve opens. The mechanism is initially adjusted so that the spring deflection is approximately one half the deflection required to overcome the valve spring loading.

10 Claims, 8 Drawing Figures

Kg
50
40
30
20
10
5
0
50
100
150
1/100 mm
65/100
B
A
CONTINUOUS CONTACT
ON BASE CIRCLE

ACTUATION OF VALVES OF INTERNAL COMBUSTION ENGINES

BACKGROUND OF THE INVENTION

The invention relates to internal combustion engines of the kind in which the movement of fluids is controlled by poppet valves. The opening of the valves is effected by rotating cams, generally via associated parts such as tappets, push rods and rockers, against the action of strong valve springs which urge the valves towards and close them against their respective valve seats.

Due to thermal expansion of the valves and other parts of the engine, a certain clearance gap has to be provided in each chain of valve actuating mechanism between a cam surface and the end of the stem of the valve actuated thereby in order to ensure that the valve can be firmly closed against its valve seat during the appropriate period of the engine cycle. Failure of a valve to close fully not only results in bad engine performance but also in burning of the valve and its seat, and atmospheric pollution above prescribed limits. Any excess clearance leads to an undesirable tapping noise, and consequently the clearance gap is normally adjusted within a range which ensures proper valve closure under the various operating conditions of the engine while maintaining the noise as low as possible in the circumstances. However, due to wear which occurs between the valve and its seat and between the engaging surfaces of the chain of valve mechanism from the cam surface to the valve stem, which can either increase or decrease the said clearance gap depending upon the conditions of engine operation, the clearance gap has to be adjusted several times during the life of the engine. Some engines are equipped with self-adjusting hydraulic tappets for automatically adjusting the clearance, engine oil pressure causing the tappets to lengthen and automatically take up the clearance during engine operation, but with most engines re-adjustment of the clearance gap has to be effected manually from time to time.

The reduction of the clearance due to wear between the valve and its seat is of critical importance, and while it is offset to some extent by the wear between the engaging surfaces of the valve actuating mechanism, it remains a serious problem. The use of lead-less gasoline to reduce pollution has accelerated wear between the valve and its seat which, where it is not possible to incorporate hydraulic tappets, has had to be slowed down by expensive means, such as sodium-cooled valves, in an attempt to avoid clearance gap adjustment being necessary more frequently than the permissible interval between maintenance of other parts of the vehicle, which intervals continue to become longer by the use of improved materials and mechanical design.

Various valve-actuating arrangements incorporating mechanical springs or expansion compensating devices have been proposed or used during the last half century for reducing or silencing tappet noise. Examples of such arrangements are described in U.S. Pat. No. 1,613,117 of J. C. Miller issued Jan. 4, 1927, U.S. Pat. No. 1,692,435 of A. Clemensen issued Nov. 20, 1928, U.K. Pat. No. 305,522 of A. H. F. Perl, U.S. Pat. No. 2,225,265 of G. M. Fitts issued Dec. 17, 1940 and U.S. Pat. No. 3,183,901 of N. C. Thuesen issued May 18, 1965.

To the best of applicant's knowledge and belief, the problem faced by automobile manufacturers of maintaining atmospheric pollution from exhaust gases below prescribed limits over a specified interval of operation, and without interim valve clearance adjustment, has not hitherto been solved by an inexpensive mechanical spring system which is simple to fabricate and can be incorporated easily in existing or new engine designs.

SUMMARY OF THE INVENTION

An object of the invention is to provide an actuating mechanism for poppet valves of internal combustion engines, or a device or combination of parts for modifying existing valve mechanism, comprising a simple and inexpensive mechanical spring system which automatically compensates for variations in the said clearance gap due to temperature changes and wear and thereby considerably lengthens the time an engine can be in operation before manual re-adjustment of the clearance gap becomes necessary.

Another object of the invention is to provide such a valve actuating mechanism, device or apparatus comprising a mechanical spring system which is simple, inexpensive and light and which can produce a force which increases at such a variable rate with respect to the deformation of the spring that said spring force increases from zero to a value in excess of that exerted by the valve spring of the valve to be actuated during a spring deformation of the order of 1.0 mm in the case of a medium sized motor car engine, or more generally of the order of one tenth of the lift of the valves of the engine.

The invention consists in an internal combustion engine having cam-operated poppet valves which are urged to close on their valve seats by valve springs and having a spring located in the clearance gap in each chain of valve-actuating mechanism between a cam surface and the end of a valve stem, said spring comprising a thin metal disc or assembly of thin metal discs located between two movable members in said chain of mechanism, the first of said members having a convex surface engaging one face of said spring disc approximately centrally and the second of said members having an annular surface engaging the other face of the spring disc around its periphery so that when said members are moved towards one another said spring disc is deflected and caused to deform around said convex surface, characterized in that the inner perimeter of said annular surface lies within the outer perimeter of said convex surface, the disc spring is substantially free of perforations so that said convex surface engages progressively increasing areas of the adjacent face of the disc spring from its centre as the spring is progressively deformed about said convex surface, the convex surface and disc spring cooperating to produce a spring force, as the spring is progressively deflected and deformed about said convex surface, which increases at a variable rate from zero to a value in excess of that exerted by the valve spring of the valve to be actuated during relative movement between said two members less than that required to deflect the periphery of the disc spring to its permitted maximum, the disc spring being partially deflected at initial adjustment of the valve-actuating mechanism.

The disc spring may be deflected at initial adjustment to approximately one half of its deflection required to produce a spring force equal to that exerted by the valve spring under static conditions.

The part-spherical surface should have a radius which is large relative to the thickness of the disc or discs in order to avoid fatigue and breakage. Conveniently, the spring system is such that, for a motor car engine of medium size, the maximum relative movement before the two members reach "solid" contact is of the order of 0.5 mm to 1.5 mm. The radius of curvature of the spherical surface should be of the order of 500 times the thickness of the spring material from which a disc is made. Two or more discs may be positioned between the two members to achieve the desired spring force and rate of spring force variation within the permitted maximum movement. The spring force increases to only a very low value over the first half of the permissible movement, then increases more rapidly and finally increases very rapidly to exceed the static force of the valve spring to be compressed before the maximum possible deformation is achieved. Since, during deformation, the spring disc progressively wraps itself around the convex surface, noise is substantially eliminated as also is wear on the opposing surfaces of the spring system.

DESCRIPTION OF THE PREFERRED EMBODIMENT

Figure 1:
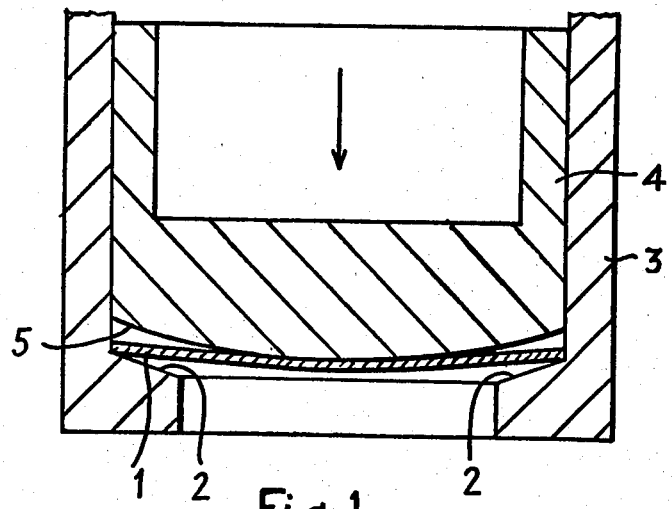
FIGS. 1 and 2 are diagrams explaining the operation of the spring system of this invention.

The functioning of the spring system according to the invention is explained with reference to FIGS. 1 and 2. The spring system comprises a thin disc 1 of springy metal which is engaged around its periphery on one face by an annular abutment surface 2 at the end of a cylinder 3 in which slides a piston 4 having a convex end surface 5, the centre of which engages the approximate centre of the disc 1 as shown in FIG. 1.

Figure 2:
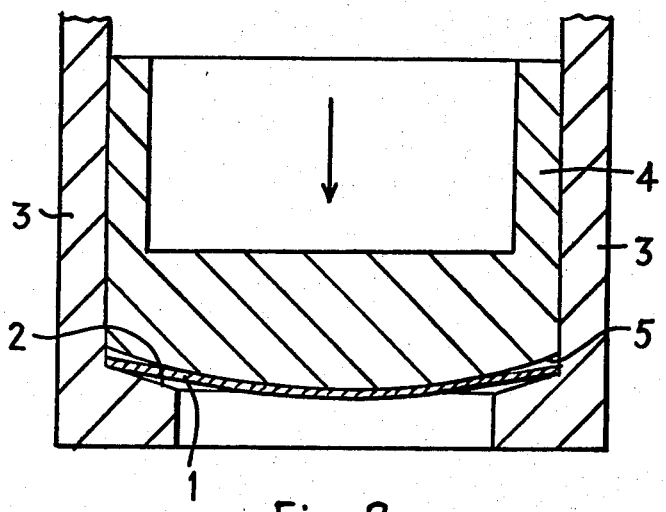

If the piston surface 5 is moved towards the abutment surface 2 in the direction of the arrow, the disc will wrap itself around the convex surface 5 as shown in FIG. 2, the area of contact increasing from the centre outwardly as the piston moves until "solid" contact is made at the limit of permissible movement of the piston. Preferably the abutment surfaces 2 are concave to correspond approximately with the convexity of the surface 5.

The spring force (or reaction) exerted by such a system relative to axial movement of the piston 4 towards surface 2 increases at a variable rate. The spring force is very low in the initial stage of deformation and increases very rapidly in the later stages of deformation as the piston approaches the limit of its permitted movement, as indicated by the typical curve of FIG. 3 in which spring force is plotted against piston movement. The rate of increase can be adjusted as required by design of the geometrical shape of the surface 5.

Figure 3:
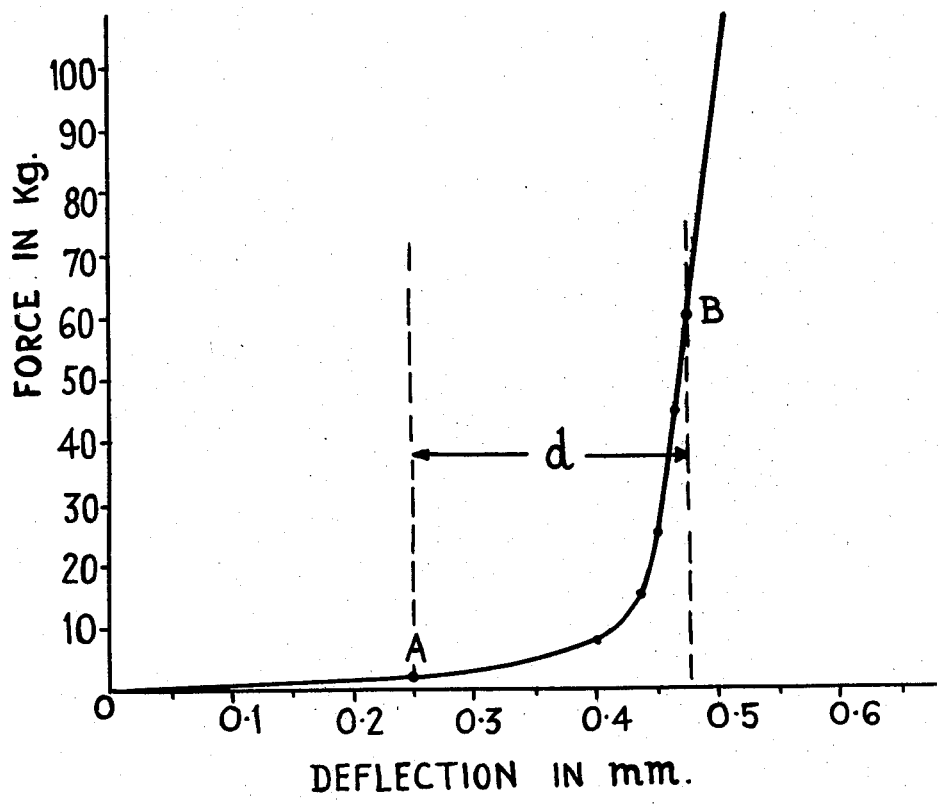
FIG. 3 is a curve showing the increase in spring force with increasing deflection.

As will be apparent from FIG. 3, the unusual characteristics of the curve of a spring of this invention make it possible to choose a very light force at the "rest" position A in which the valve rests on its seat while also producing the large force necessary to compress the valve spring while the disc has still some travel left before making "solid" contact with surface 5.

In practice, the total axial travel in the case of such a system interposed in the valve actuating mechanism of a medium sized motor car engine would be of the order of 0.5 mm to 1.5 mm. The rest position A in FIG. 3 could, for instance, be at one-half of the total of the permissible travel of the spring system. At this point, the disc 1 is partially wrapped around the surface 5. The spring force at this point may be of the order of 5 kg. As the piston 4 moves closer to the abutment surface 2, the spring force at point B reaches a value which is of the order of 60 kg which is sufficient to overcome a static force of 40 kg of a valve spring and the inertia forces of the valve and related parts, forces that in this numerical example are typical of the middle range of rotational speeds of the engine. In this instance the valve would be lifted from its seat at the point B. At low speeds, for example for speeds of the order of 800 rpm, inertia forces would be near to nil and the lifting of the valve from its seat would occur at a point to the left of B, while at high rotational speeds this would occur at the right of B.

As the disc 1 remains in contact with the surfaces 2 and 5 during engine operation and bridges the clearance gap, it can be called a "continuous contact disc." In practice, disc 1 may comprise two or more thin metal discs assembled together. To keep the mechanical stress in the or each thin steel disc well within the fatigue limit, the minimum radius of the convex surface 5 should not be less than 500 times the thickness of the disc or of each of the discs. The diameter of the disc may be of the order of 100 times its thickness.

The spring system is simple, inexpensive, compact and light and can be fitted at any position between the cam and valve stem as will be apparent from various embodiments of the invention which will now be described with reference to FIGS. 4–7. In each of the Figures, the same parts are indicated by the same reference numerals.

Figure 4:
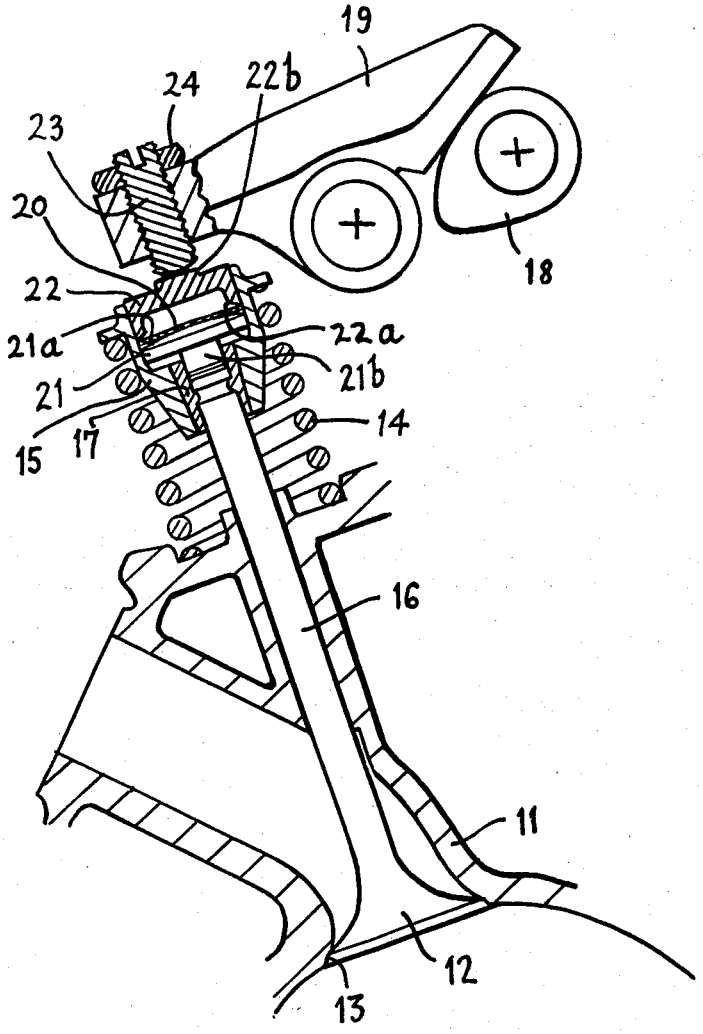
FIG. 4 is a practical embodiment of one form of the invention for use with an engine having an overhead camshaft.

FIG. 4 shows the head casting 11 of the engine. The valve 12 is urged against its seat 13 by a valve spring 14 which is retained under compression by a spring retainer 15 secured to the end of the valve stem 16 by split cotters 17. The valve is adapted to be actuated by a cam 18 via a rocker 19. The spring system according to the invention comprises a disc 20 consisting of one or several thin discs of spring metal and located between a first member 21 having a head with a convex upper surface 21*a* and a stem portion 21*b* which abuts the end of the valve stem 17, and a second member 22 in the form of a hollow piston. The first and second members and the contact disc 20 are located and movable axially in a cylindrical cavity in the spring retainer 15. The lower peripheral surface 22*a* of the second member, which surface is preferably of generally concave form corresponding to the convexity of the surface 21*a* of the member 21, abuts the periphery of the upper face of the contact disc 20, and the centre of the convex surface 21*a* abuts the centre of the lower face of the contact disc 20. The piston member 22 also has an upwardly projecting stem 22*b* which is adapted to engage an adjustable screw 23 in the rocker 19 which can be locked in its adjusted position by a lock-nut 24.

The total axial travel of the piston 22 in the retainer 15 can be of the order of 0.5 to 1.0 mm. For a motor car engine of medium size of which the static load of the valve spring 14 is of the order of 40 kg, the contact disc 20 may consist of two steel discs each of a thickness of 0.15 mm and a diameter of 19 mm. The radius of the convex surface 21*a* is conveniently 85 mm. The spring system is adjusted so that in the rest position A (FIG. 3) the piston 22 is depressed by about 0.25 mm, in which position the force exerted by the spring system is very small, of the order of 2 kg. When the piston 22 is depressed by distance d, approximately a further 0.23 mm, the spring force is approximately 60 kg which is sufficient to compress the valve spring 4. In these circumstances, variations of 0.25 mm at the left of the rest position (with reference to FIG. 3) can be accommodated without the system leaving a free gap which is likely to produce noise. On the other hand a displacement of 0.20 mm to the right would correspond to a force of 25 kg, which would still leave available a static effort of 15 kg to press the valve against its seat.

To adjust the spring system, the cam 18 is first turned to the rest position, that is with the rocker engaging the base circle of the cam. A shim or gauge (not shown) corresponding to the distance d between the points A and B in FIG. 3 is inserted between the end of the valve stem 16 and the screw 23 and the screw is adjusted until the spring 14 starts to be compressed. This may be detected by a comparator placed in contact with the spring retainer 15. The force (reaction) of the spring system has now reached point B of FIG. 3. The screw 23 is then locked in this position by the lock-nut 24 and the adjusting shim is removed. Disc 20 presses piston 22 against screw 23 thus regaining the travel corresponding to the shim d and the spring system is adjusted to position A.

Figure 5:
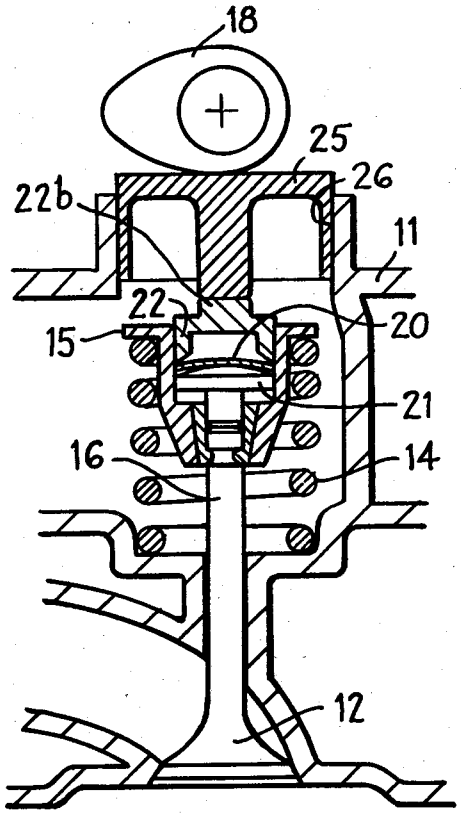
FIG. 5 is a modification of FIG. 4.

FIG. 5 shows a modification in which the valve 12 is actuated by a cam 18 via a tappet 25 slidable in an aperture 26 in the engine casting 11. The spring system in this embodiment is substantially as shown in FIG. 4 and is accommodated in the spring retainer 15, the stem 22*b* being actuated by a central extension of the tappet 25.

No means of adjusting the relative axial positions of the spring system during initial assembly are shown in FIG. 5. These could take the form of graded sets of members 21 or 22 or of additional shims conveniently placed.

Figure 6:
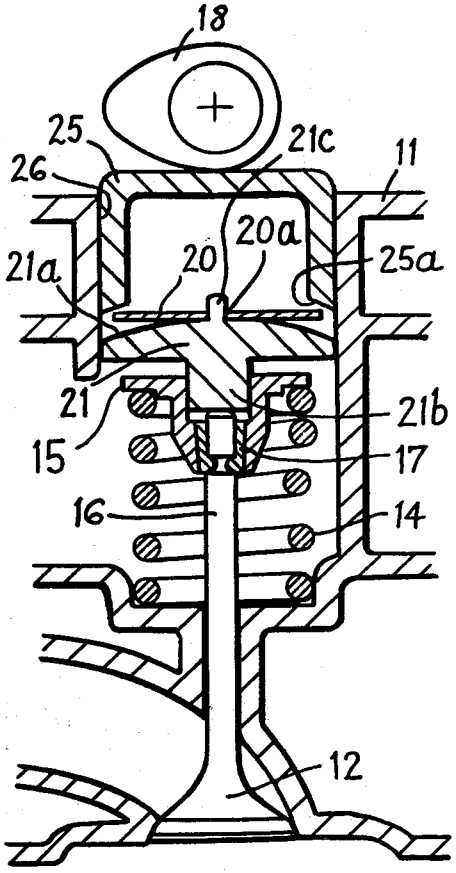
FIG. 6 shows a further embodiment of the invention applied to an engine in which the valve is actuated by an overhead camshaft.

FIG. 6 shows a further modification in which the disc 20 is located between a member 21 of which the convex head is of larger diameter than the spring retainer 15 and extends thereabove into the aperture 26 in the head casting 11 in which the tappet 25 is guided. The disc 20 is positioned between the convex surface 21*a* of the member 21 and the annular surface 25*a* at the bottom of the tappet 25. This surface 25*a* is preferably concave to conform with the convexity of the surface 21*a*. The stem 21*b* of the member 21 again directly engages the end of the valve stem 16. The disc 20 may be centralised on the convex surface 21*a* by providing it with a small central aperture 20*a* which locates on a peg or pin 21*c* projecting from the centre of the convex surface 21*a* of the member 21.

Figure 7:
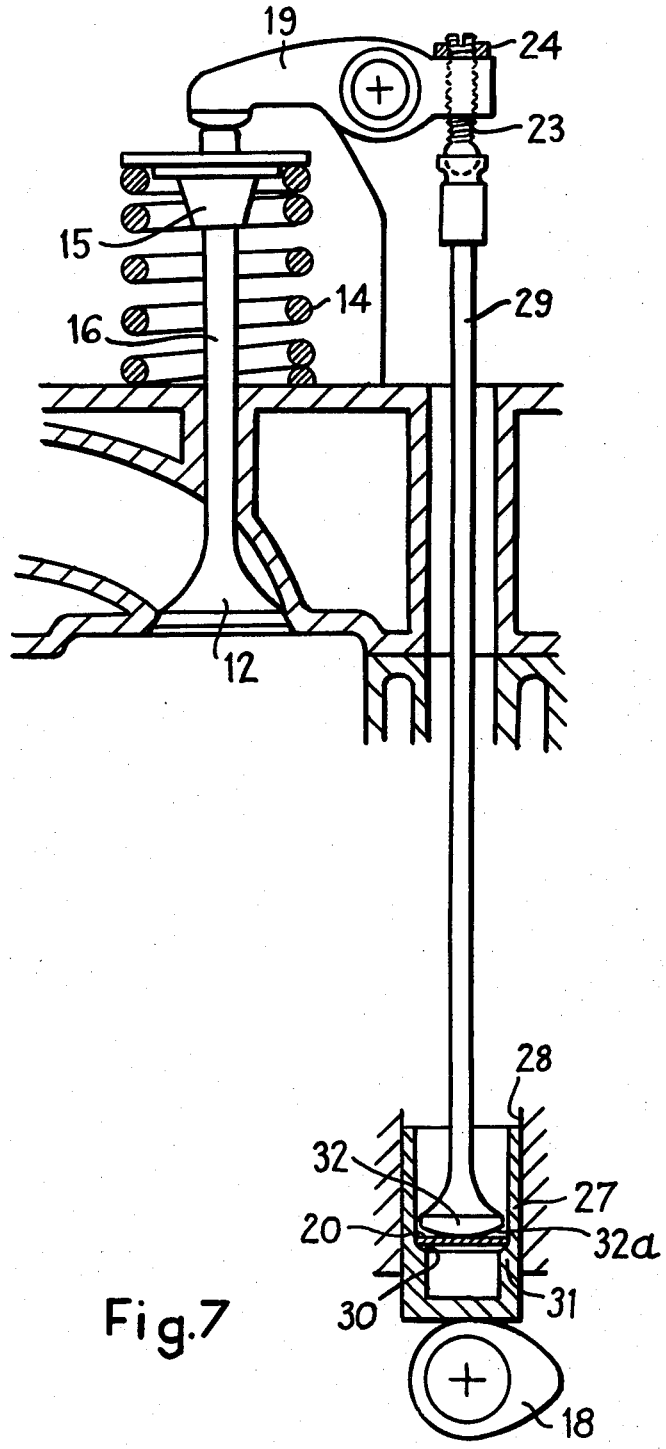
FIG. 7 shows an embodiment of the invention as applied to an engine having overhead valves actuated from a camshaft in the engine housing.

FIG. 7 shows a further embodiment suitable for engines of which the valves 12 are actuated by overhead rockers 19 from cams 18 arranged in the engine crank case. The cams actuate the rockers via tappets 27, guided in apertures 28 in the cylinder block, and push rods 29.

In the embodiment shown, the spring system incorporated in the tappet 27 comprises the contact disc 20 resting on the concave surface 30 on the shoulder 31 of the tappet. The lower end of the push rod 29 is provided with a head 32 having a convex surface 32*a* resting on the disc. The spring system operates as above described and can be adjusted to the rest position A by adjustment of the screw 23, the adjustment shim or gauge being interposed between the rocker 19 and the end of the valve stem 16.

Figure 8:
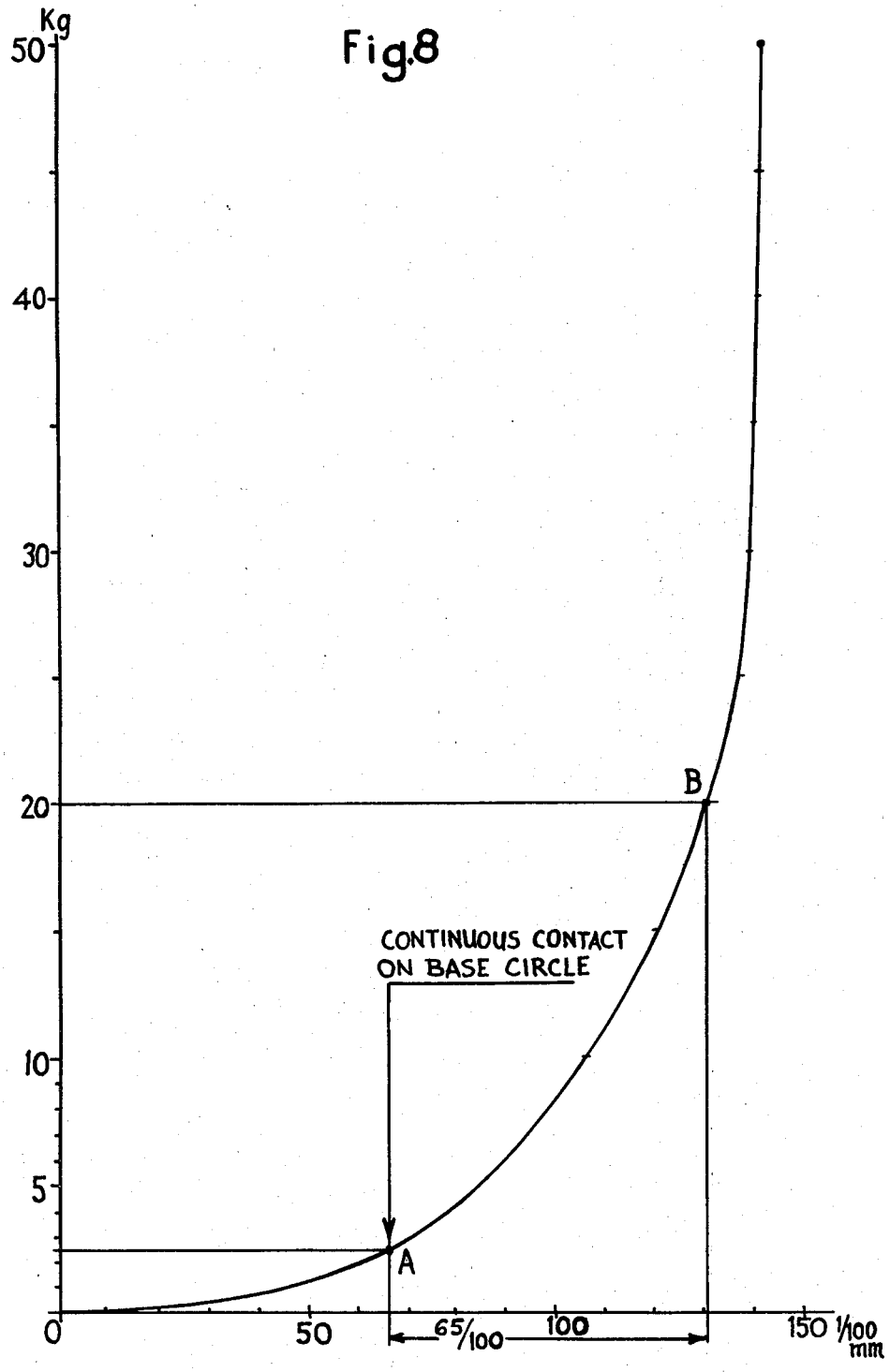
FIG. 8 is a curve similar to FIG. 3 of another embodiment.

FIG. 8 is a curve, similar to FIG. 3, showing the increase in spring force with increasing deflection, derived by practical tests on another embodiment of spring system according to the invention for incorporation in tappets directly acting on the valves of the engine in a manner similar to that shown in FIG. 6. The valves had a lift of 9.5 cms and the valve springs were of variable rate construction (varying pitch of helix) producing an initial loading of 20 kg. The spring consisted of a simple circular disc of Sandvik 20 C Steel, 0.20 mm thick, with a diameter of 33 mm, and imperforate except for a small centralising hole 20*a* of 3 mm diameter. The convex surface had a radius of 100.9 mm.

With this arrangement, the total deflection to "solid" contact is 1.42 mm. The spring force at different deflections are indicated in the following Table, and represented on the curve of FIG. 8.

| Deflection 1/100 mm | 37 | 46 | 67 | 84.5 | 103 | 121 | 131 | 140 | 142 |
|---|---|---|---|---|---|---|---|---|---|
| Force kg | 0.61 | 1.11 | 2.6 | 5 | 9 | 15 | 20 | 35 | 50 |

The rest position A was selected at a deflection of 0.67 mm where the spring force was 2.6 kg. A further deflection of 0.65 m was required before point B is reached and the spring force was sufficient to lift the valve under static conditions. Wear between the valve and its seat sufficient to reduce the clearance gap by 0.5 mm can therefore occur, while still leaving a margin of safety, before there is risk of a valve not closing on its seat. This is approximately 2½ times the average clearance gap of a medium size motor car engine.

The system according to the invention is a "fail-safe" system. If the spring should fracture, the valves will continue to be actuated and the engine will run, although of course with more tappet noise. There is no risk of the valves failing to close.

While particular embodiments have been described, it will be understood that various modifications may be made without departing from the scope of the invention. The periphery of the disc can be circular or of polygonal form; it should not be shaped with cutaways producing spring fingers which prevent the drammatically steep rise in the force/deflection curve, from an initial light force over approximately one half of the small total deflection which is characteristic of the spring system of this invention. The convex surface need not be truly part-spherical but may have a varying curvature to achieve a desired spring rate.

I claim:

1. An internal combustion engine having cam-operated poppet valves which are urged to close on their valve seats by valve springs and having spring means located in the clearance gap in each chain of valve-actuating mechanism between a cam surface and the end of a valve stem, said spring means being constituted by a disc spring comprising at least one thin metal disc located between two relatively movable members in said chain of mechanism, the first of said movable members having a convex surface engaging one face of said disc spring approximately centrally and the second of said movable members having an annular surface engaging the other face of the disc spring around its periphery so that when said members are moved towards one another said convex surface engages progressively increasing areas of the adjacent face of the disc spring from its centre as the disc spring is progressively deformed about said convex surface, the convex surface and the disc spring cooperating to produce a spring force, as the disc spring is progressively deflected and deformed about said convex surface, which increases at an increasing variable rate from zero when relaxed to a permitted maximum value which corresponds with the maximum relative movement between said two movable members and which has a force-deflection ratio which is low during a portion of its deflection from a relaxed state and which increases very rapidly as said maximum value is approached, and wherein the inner perimeter of said annular surface lies within the outer perimeter of said convex surface, the disc spring is free of perforations in its working surface and is unrestricted to cooperate with said convex surface such that said spring force of the disc reaches a value in excess of the static force exerted by the valve spring, and begins to open the valve during relative movement between said two movable members less than that required to deflect the periphery of the disc spring to its permitted maximum, the disc spring being partially deflected at an initial adjustment of the valve-actuating mechanism to a position in which the force-deflection ratio is low, whereby variations in the clearance gap during engine operation are automatically compensated for.

2. An engine according to claim 1, characterized in that the disc spring is deflected at initial adjustment of the valve-actuating mechanism to approximately one half of is deflection required to produce a spring force equal to that exerted by the valve spring under static conditions.

3. An engine according to claim 1, characterized in that the radius of curvature of said convex surface of said first member is not less than 500 times the thickness of a thin metal disc of the disc spring.

4. An engine according to claim 1, characterized in that the annular surface of the second member which engages the said other face of the disc spring is concave to correspond approximately with the convexity of said convex surface.

5. An engine according to claim 1, characterized in that the spring and the two members are incorporated in a bore in a retainer for the valve spring, one of said members to which the cam movements are imparted being slidable in said bore.

6. An engine according to claim 1, characterized in that the spring is located in a hollow cylindrical tappet having an open end and which is provided internally with one of said members against which one face of the spring rests, the other member extending into the tappet through its open end and engaging the other face of the spring.

7. An engine according to claim 1, characterized in that the force of the spring can be increased from zero to a value exceeding the loading of the valve spring by moving the two members closer together by a distance not exceeding 1 mm.

8. An engine according to claim 1, characterized in that the disc spring is provided with a small hole at its centre which locates on a projection at the centre of said convex surface.

9. Conversion kit for adapting an internal combustion engine to the construction according to claim 1, comprising a disc spring comprising at least one metal disc free from perforations in its working surface, a first member having a circular head of approximately the same diameter as said disc spring and with a part-spherical convex end surface of which the radius of curvature is not less than 500 times the thickness of said at least one disc, a second member comprising an annular concave surface corresponding approximately with the convexity of said convex surface and of which the internal diameter of said concave surface is less than the external diameter of the head of said first member, the diameter and spring characteristics of said at least one disc and the radius of curvature of said convex surface being such that by deforming the disc spring around said convex surface by deflecting the periphery of the disc spring towards the convex surface by moving said annular surface theretowards, a spring force of the order of at least 50 Kg can be produced by deflecting the periphery of the disc spring by a distance of between 0.5 mm and 1.5 mm.

10. Conversion kit according to claim 9, wherein said at least one thin disc is provided with a central aperture which locates on a projection from the centre of the convex surface of said first member.

* * * * *